US010052905B2

(12) United States Patent
Lim

(10) Patent No.: US 10,052,905 B2
(45) Date of Patent: Aug. 21, 2018

(54) MULTI-USE BINDER CLIP

(71) Applicant: Stephen Sophorn Lim, Desert Hot Springs, CA (US)

(72) Inventor: Stephen Sophorn Lim, Desert Hot Springs, CA (US)

( * ) Notice: Subject to any disclaimer, the term of this patent is extended or adjusted under 35 U.S.C. 154(b) by 198 days.

(21) Appl. No.: 15/258,674

(22) Filed: Sep. 7, 2016

(65) Prior Publication Data

US 2018/0065398 A1 Mar. 8, 2018

(51) Int. Cl.
*B42F 1/02* (2006.01)
*B42F 1/00* (2006.01)

(52) U.S. Cl.
CPC ..... *B42F 1/006* (2013.01)

(58) Field of Classification Search
CPC ..... B42F 1/006; Y10T 24/202; Y10T 24/203
USPC ..... 24/67.7
See application file for complete search history.

(56) References Cited

U.S. PATENT DOCUMENTS 363,525 A * 5/1887 Lipp ..... G09F 1/14 248/288.31
1,420,654 A * 6/1922 Grant ..... B42F 1/006 24/334
2,118,043 A * 5/1938 Goza ..... B42F 19/00 40/641
2,435,174 A * 1/1948 Bell ..... D06F 55/00 24/115 A
3,286,381 A * 11/1966 Wooge ..... B42F 21/00 24/67.5
4,332,060 A * 6/1982 Sato ..... B42F 1/06 24/456
8,397,410 B1 * 3/2013 Lau ..... B42F 1/006 116/236
9,199,506 B2 * 12/2015 Lim ..... B42F 1/006
2001/0032376 A1 * 10/2001 Payne ..... B42F 1/006 24/67.5
2014/0201951 A1 * 7/2014 Starken ..... B42F 1/006 24/67.5

FOREIGN PATENT DOCUMENTS

DE 367486 C * 1/1923 ..... B42F 1/006

* cited by examiner

*Primary Examiner* — Joshua T Kennedy

(57) ABSTRACT

A binder clip to deliver method of carrying stack of papers can be further implemented outside its application zone, with the redesign of the previous annexed wings and clip body of U.S. Pat. No. 9,199,506 introduces the Multi-Use Binder Clip with moveable protruded structures; that suspends along the folded edges of the clip body with incision cuts at the contour center plane and clip body sides; which protruded structure is formed by shaping a nominal diameter wire derives two half loops and one full loop wire components, lengths at each sides, shape, angle, and bend counter to each other, hinges to the clip body along with prior art grip handles; where the redesigned binder clip provides many more applicable functions.

1 Claim, 3 Drawing Sheets

MULTI-USE BINDER CLIP

CROSS-REFERENCE TO RELATED APPLICATION

U.S. Pat. No. 9,199,506 B2 File Date: Jun. 27, 2013

FEDERALLY SPONSORED RESEARCH

Not Applicable

SEQUENCE LISTING OR PROGRAM

Not Applicable

BACKGROUND OF THE INVENTION

Field of Invention

This invention supersedes some of the designs of the previous U.S. Pat. No. 9,199,506 B2, "Hole-Punched Binder Clip" to pursue better handling and more applications, modifies the annexed wings for a set of wire loop ring inserted at the folded edges of the clip body of the Multi-Use Binder Clip, which wire loop rings can be positioned along the folded edges of the clip body, where incision cuts to the clip body is situated at about the center contour planes and two folded edges, contrary to the D-cut on the clip body sides of the previous "Hole-Punched Binder Clip". The Multi-Use Binder Clip redesigned allows for more application like in workshops and any binder clips implementation that is everyday essential, along with the previous applications for storing, organizing, transporting documents, and/or other creative applications in office and many other binder clip environments.

Description of Prior Invention

A binder clip typically grips stack of papers have been known, which early design is effective but big and bulky. In the U.S. Pat. No. 1,133,388 released on Mar. 30, 1915, Frank E. Merril developed a clip with tag holder and grip handles protrude, where holes in the handle seems to be made for hanging but seems to be for stabling the grip handle design. The big and bulky product grips papers well, and recognition for Merril's work and others contributed thereafter of modifications for better handling and effectiveness of the clip continue to deliver results.

Objects and Advantages

In the previous U.S. Pat. No. 9,199,506, the binder clip with a protrusion, positioned normal to the center fold of the clip body with holes known as annexed wings is a one component piece that delivers many uses but the new modification, now known as the Multi-Use Binder Clip, replaces the protrusion to contain a wire loop ring at about the center contour curve folded edges, which pivots about its axis enhances for clearance at about the center contour plane for implementation other than the binder folder i.e. carrying report, documents, etc. by hand or placed inside a folder. The wire loop rings have many functions and advantages when derived with this embodiment, which application includes holding business card, postcard, photo, etc. in the looped slot, where ideal environment may be workshops, repair shops, maintenance facilities i.e. grip work orders and place client contact information are few examples. The wire loop rings derives many position along the folded edges, when rest on each side of the clip body, eliminates the protrusions at the center contour plane which then can act like a conventional binder clip, where reports and/or documents can be gripped with the clip and if choose can be hand delivered or inside folder.

SUMMARY OF THE INVENTION

This invention is to introduce the Multi-Use Binder Clip, which is an enhancement design from the previous U.S. Pat. No. 9,199,506, which annexed wing with hole punched is superseded with component independent to the clip body but are hinged. The annexed wing is now known as the wire loop ring is an independent component piece in which the present invention derives many more applications for functions and operations; with it pivotal motion along the folded edges axis of the clip body, can delivers similar functions like that of previous applications, in an office environment implementation, for storing, organizing, transporting documents, etc. The wire loop rings further provides other functional operations like in a workshop environment, when work orders are gripped with the Multi-Use Binder Clip and one of the wire loop ring can be pinned on the wall, bulletin board, and the other wire loop ring can pivot to insert and place business cards, postcards, photos, etc.

The mechanics of the wire loop ring is developed with a wire spiraled to a nominal loop diameter allowable for both nominal length ends, shaped to center along its loop ring plane, angled and bend counter to each end, to insert into the rolled ends along each of the folded edge axis of the clip body, derives a swinging motion which clicks into position, when the wing loop rings are meet at the center contour plane of the clip body, the feature satisfy, if not better applications with the previous implementation in an office environment for storing, organizing, transporting of documents, etc. inside a three ring binder folder. Contrary position, when the wire loop ring clicks into the resting position of the clip body sides, other creative implementations can be used like sorting, storing, organizing documents or reports inside a folder or just implementing the multi-use binder clip.

Other application ideas are hanging a stack of papers on the wall or a bulletin board; the wire loop rings can be used to hold business cards, postcards, photos, etc. Overall, the Multi-Use Binder Clip is designed for all imaginable applications by method of gripping stacks of papers in mind and are not limited to just an office environment but with addition to function with other various environments like corporate offices, small businesses, educational institutes, homes, workshops, etc.

BRIEF DESCRIPTION OF THE DRAWINGS

Below is a brief description of the drawings, which also illustrates the components assemblies, applications, and views along with the reference number for the Multi-use Binder Clip.

DRAWINGS

Reference Numerals

| | | | |
|---|---|---|---|
| 100 | Wire Loop Ring | 110 | Incision Cuts |
| 112 | Rolled Inserts | 114 | Clip Body |
| 116 | Folded Edges | 118 | Wire Loop Ring Ends |
| 120 | Center Contour Plane | | |

DETAILED DESCRIPTION OF THE INVENTION

FIG. 1—Embodiment

Figure 1:
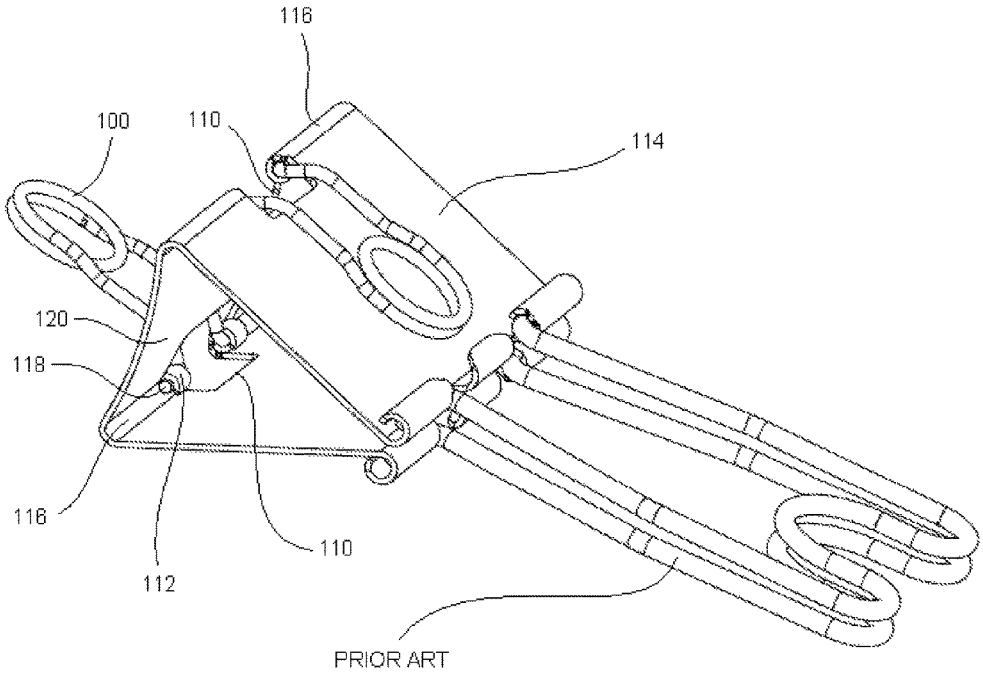
FIG. 1 illustrates the entire assembly of the multi-use binder clip with the wire loop rings, clip body, and grip handles from prior art in three-dimensional view and reference numbers.

An embodiment of the invention in FIG. 1 derives a Multi-use Binder Clip, which comprises of the Clip Body (114), Wire Loop Ring (100), and the grip handles from prior art. Wire Loop Ring (100) is situated at the Center Contour Plane (120) with Incision Cuts (110) introduced at about portion of the two Folded Edges (116) with options to maneuver to each Clip Body (114) sides. Each Wire Loop Ring (100) suspends with the Wire Loop Ring Ends (118) placed inside the four Rolled Inserts (112), which takes movement position along the Folded Edges (116) axis of the Incision Cuts (110) sides.

Figure 2:
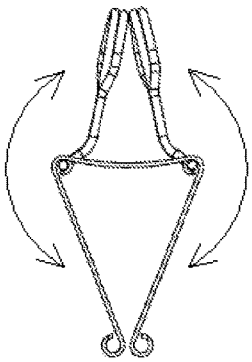
FIGS. 2 to 2A is the side views, which illustrate the motion feature of the wire loop rings assembled to the clip body.
Figure 2A:
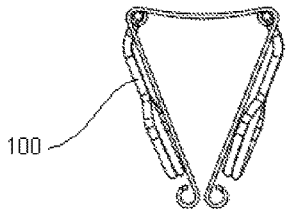

FIGS. 2-2A—Embodiment

An embodiment comprises of the Wire Loop Ring (100) assembled to the Clip Body (114) is side profiled, there introduces the directional motion of the Multi-Use Binder Clip feature, where Wire Loop Ring (100) at each Folded Edges (116) engages for application to join; contrary counter motion, results for the Wire Loop Ring (100) to rest on each sides of the Clip Body (114).

FIG. 3—Embodiment

Figure 3:
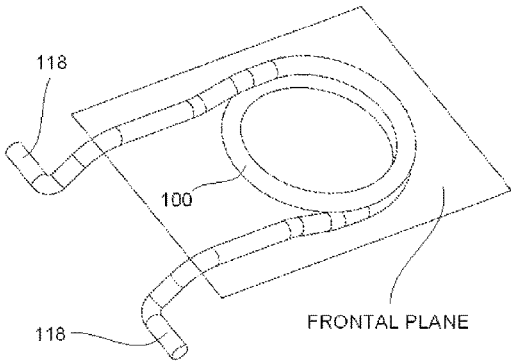
FIGS. 3 and 3A illustrates the wire loop ring and clip body with incision cuts along the folded edges in three-dimensional views.

An embodiment of the invention in FIG. 3 derives a Wire Loop Ring (100), which wire spirals into a loop, forms a ring-like shape, where each sides of the remaining wires to shape along the frontal plane sides, angle after nominal length and bends counter to each other result with two Wire Loop Ring Ends (118).

FIG. 3A—Embodiment

Figure 3A:
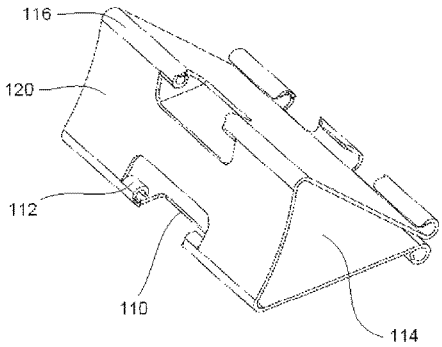

An embodiment of the invention in FIG. 3A details a Clip Body (114), a thin metal band with two folds transform into a triangular shape derives Folded Edges (116) with Incision Cuts (110) at about the Center Contour Plane (120) and Clip Body (114) sides. Along the Folded Edge (116) Incision Cuts (110) portion embodies four Rolled Inserts (112).

FIG. 4—Embodiment

Figure 4:
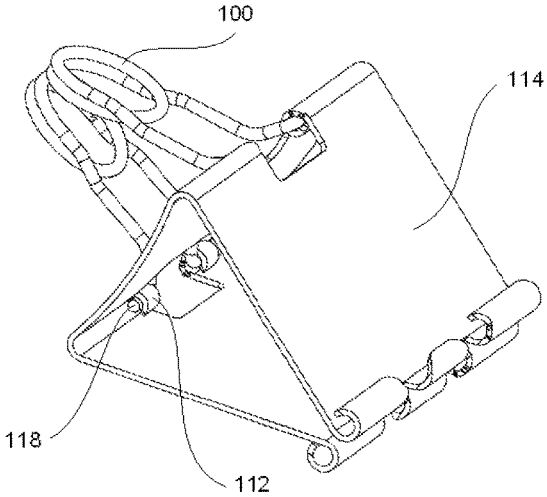
FIG. 4 illustrates an assembly of the wire loop ring and clip body with incision cuts along the folded edges detailed in three-dimensional views.

An embodiment of the invention in FIG. 4 comprises of the Wire Loop Ring (100) and Clip Body (114) with Rolled Inserts (112), profiled in three-dimensional view, associates two Wire Loop Rings (100) at Wire Loop Ring Ends (118) suspends to four Rolled Inserts (112) of the Clip Body (114).

Figure 5:
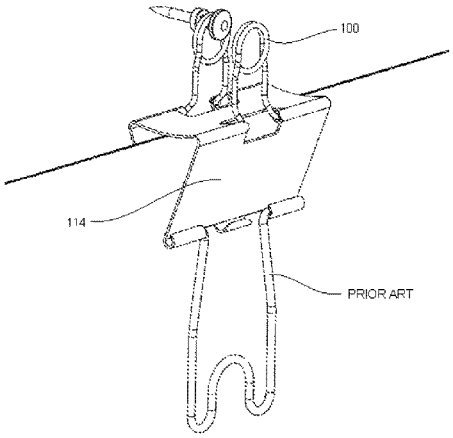
FIG. 5 illustrates application ideas for implementing the multi-use binder clip by method of hanging mount product while gripping stack of papers in three-dimensional view.

FIGS. 5—Embodiment

An embodiment of the invention in FIG. 5 exhibits an application method, with one of the Wire Loop Ring (100) engages with a hanging mount product suspends the Clip Body (114) grips a stack of papers with the grip handle from prior art hangs parallel to the papers.

FIG. 6—Embodiment

Figure 6:
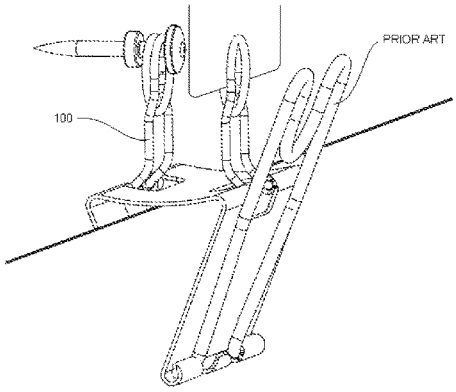
FIG. 6 illustrates application ideas for implementing the wire loop ring as a business card, post card, photo, and/or any related holder while gripping stack of papers in three-dimensional view.

An embodiment of the invention in FIG. 6 exhibits an application method, with one of the Wire Loop Ring (100) engages with a hanging mount product, while the other Wire Loop Ring (100) holds a card, and Clip Body (114) grips a stack of papers. The position of the grip handle of prior art rests on one side of the Clip Body (114) is an option to add or release papers when essential.

FIG. 7—Embodiment

Figure 7:
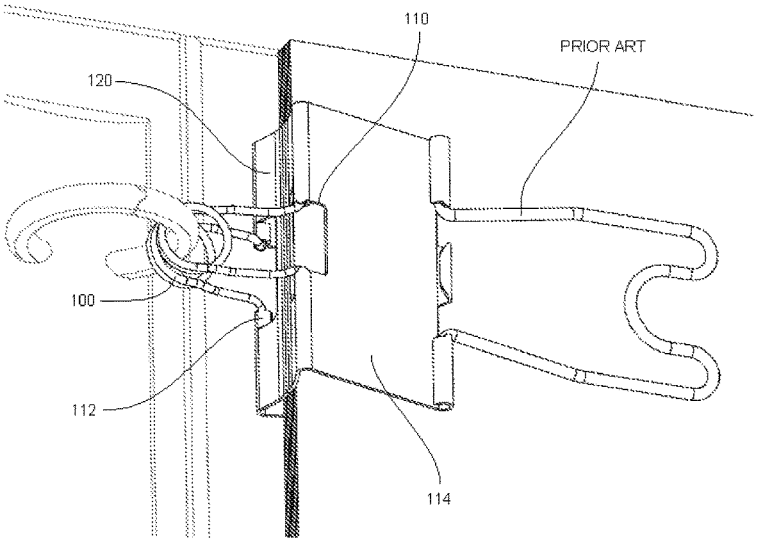
FIG. 7 illustrates application ideas for implementing the multi-use binder clip inside a three-ring binder folder and gripping papers in three-dimensional view.

An embodiment of the invention in FIG. 7 exhibits an application method, with both Wire Loop Rings (100) suspend at the four Rolled Inserts (112) at about the Incision Cuts (110) meet normal to Center Contour Plane (120) of Clip Body (114) is suspended to a binder folder ring, where the Clip Body (114) grips stack of papers with the grip handle of prior art rests parallel to papers.

Operations

FIGS. 2-2A, 5, 6, 7

The invention improvement for the Multi-Use Binder Clip consists of two Wire Loop Rings (100) with Wire Loop Ring Ends (118) suspends at four Rolled Inserts (112) are hinged at the two Folded Edges (116) with Incision Cuts (110) at about the Center Contour Plane (120) and the Clip Body (114). The Wire Loop Ring (100) is derived with a nominal diameter wire wound into a nominal diameter loop, there resulted in two half loops and one full loop and two extended wire ends length shaped, angled to take fit around the Incision Cuts (110) about the Clip Body (114) and bent at each ends counter to each other to take suspension at the Rolled Inserts (112). Observing at the triangular side view of the binder clip, the Wire Loop Rings (100) are developed to swing at about the two Folded Edges (116) resulting with many application implementations.

Observing in details, the Wire Loop Ring (100) with the two half loops (as top), the one loop (as bottom), profiled at side view delivers a slim U-shape slot. When slip in between the U-shape slot a card, postcard, photo, or any related paper tag, the wire loops act as a support atop portion of the card, while the bottom loop supports from slipping through the Wire Loop Ring (100). The mechanic for holding the cards can be observed in another fashion, at where the card and two half loops (top) contact may be considered the static friction that runs along the frontal plane side, while the normal force would be perpendicular to frontal plane both sides of the loops. At the other contact point the card and full loop most bottom portion, normal force counter gravity, static friction glides perpendicular to gravity direction.

The swinging action of the Wire Loop Ring (100) is derived by Wire Loop Ring Ends (118) suspending inside the four Rolled Inserts (112) of the Clip Body (114), which is situated along the Folded Edges (116) of the Clip Body (114). When force is applied typically finger action at the two half loops of the Wire Loop Ring (100), the Wire Loop Ring (100) would pivot, clicking out of position, at about its axis at the Wire Loop Ring Ends (118) and Rolled Inserts (112), there allow for the Wire Loop Ring (100) to move anywhere from the Clip Body (114) sides (see FIG. 2A) to the position normal around the Center Contour Plane (120) of the Clip Body (114).

With many uses of the Multi-Use Binder Clip, FIG. 5 shows for one of the Wire Loop Ring (100) to be pinned with a wall mount product while gripping stack of papers. Another implementation is in FIG. 6 where the Wire Loop Ring (100) assisted in another feature to hold cards, tags, and/or related materials. As it primary function was to take use inside a three ring binder folder as illustrated in FIG. 7.

The invention claimed is:

1. A binder clip, comprising:

A center portion and two clip body portions each extending from the center portion at fold edges and defining hinges at free ends thereof;

Two sets of wire grip handles suspended within the hinges and arranged parallel with the clip body portions, respectively;

A wire loop ring structure suspended within inserts located within each of the folded edges, said wire loop ring structures, when force is applied, are configured to click into position normal to a center contour plane of the clip body and when a counter force is applied, said wire loop ring structures are configured to dislodge to motion at said fold edges axis and click into rest at respective clip body sides;

Each wire loop ring structure comprising of a wire, spiraled to a nominal loop having a diameter shaped to center along a loop ring plane, said nominal loop comprises two half-loops at a top of the loop and one half-loop at the bottom of the loop to define a slim u-shape gap to allows for thin material to be inserted therein each free end of said wire is bent outwardly within the plane and inserted into the inserts.

* * * * *